US011624358B2

(12) United States Patent
Netecke

(10) Patent No.: US 11,624,358 B2
(45) Date of Patent: Apr. 11, 2023

(54) MEASURING BACKLASH OF A PUMP GEAR TRAIN

(71) Applicant: Cameron International Corporation, Houston, TX (US)

(72) Inventor: Michael Raymond Netecke, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 402 days.

(21) Appl. No.: 17/009,259

(22) Filed: Sep. 1, 2020

(65) Prior Publication Data

US 2022/0065242 A1 Mar. 3, 2022

(51) Int. Cl.

| | |
|---|---|
| ***F04B 51/00*** | (2006.01) |
| ***F04B 53/00*** | (2006.01) |
| ***F04B 9/02*** | (2006.01) |
| ***F04B 49/06*** | (2006.01) |
| *F04B 17/05* | (2006.01) |

(52) U.S. Cl.

CPC ..... *F04B 51/00* (2013.01); *F04B 9/02* (2013.01); *F04B 49/065* (2013.01); *F04B 53/006* (2013.01); *F04B 17/05* (2013.01); *F04B 2201/1208* (2013.01)

(58) Field of Classification Search

CPC ..... F04B 51/00; F04B 9/02; F04B 49/065; F04B 53/006; F04B 2201/1208

See application file for complete search history.

(56) References Cited

U.S. PATENT DOCUMENTS

| | | | | |
|---|---|---|---|---|
| 8,920,146 | B2 | 12/2014 | Heinrichs | |
| 2002/0170301 | A1* | 11/2002 | Loprete | F04B 49/126 62/160 |
| 2004/0028540 | A1* | 2/2004 | Peck | F04B 33/02 417/374 |
| 2004/0219040 | A1* | 11/2004 | Kugelev | F04B 17/03 417/415 |

(Continued)

FOREIGN PATENT DOCUMENTS

| | | | | |
|---|---|---|---|---|
| CN | 113113984 A | * | 7/2021 | F04B 35/04 |

OTHER PUBLICATIONS

Clarivate Analytics, Fixing Device For Oil Pump In Refrigeration Compressor, Jan. 2011, machine translation of JP-2011501030-A.*

(Continued)

*Primary Examiner* — Francis C Gray

(74) *Attorney, Agent, or Firm* — Cameron Sneddon

(57) ABSTRACT

Apparatus and methods for measuring backlash of a gear train of a pump unit for pumping a fluid. An example method may include locking a crankshaft of the pump unit such that the crankshaft cannot rotate. The method may further include commencing operation of a processing device to receive rotational position measurements indicative of rotational position of an output shaft of a prime mover, cause the prime mover to rotate the output shaft in a first direction until the output shaft reaches a first rotational position, and cause the prime mover to rotate the output shaft in a second direction until the output shaft reaches a second rotational position. The processing device may then determine backlash of the gear train by determining rotational distance between the first rotational position of the output shaft and the second rotational position of the output shaft.

20 Claims, 6 Drawing Sheets

(56) References Cited

U.S. PATENT DOCUMENTS

2009/0232674 A1* 9/2009 Fiorenza ..... F02N 5/00
417/364
2020/0325770 A1* 10/2020 Camacho Cardenas .....
E21B 21/08

OTHER PUBLICATIONS benTEC, "Mud Pumps", benTEC brochure, www.bentec.com, Feb. 2018, 5 pages.

* cited by examiner

MEASURING BACKLASH OF A PUMP GEAR TRAIN

BACKGROUND OF THE DISCLOSURE

Wells are generally drilled into the ground or ocean bed to recover natural deposits of oil, gas, and other materials that are trapped in subterranean formations. Well construction operations (e.g., drilling operations) may be performed at a wellsite by a well construction system (i.e., a drill rig) having various automated surface and subterranean equipment operating in a coordinated manner. For example, a drive mechanism, such as a top drive or a rotary table located at a wellsite surface, may be utilized to rotate and advance a drill string into a subterranean formation to drill a wellbore. The drill string may include a plurality of drill pipes coupled together and terminating with a drill bit. The length of the drill string may be increased by adding additional drill pipes while the depth of the wellbore increases. Drilling fluid (i.e., drilling mud) may be pumped by mud pumps from the wellsite surface down through the drill string to the drill bit. The drilling fluid lubricates and cools the drill bit and carries drill cuttings from the wellbore back to the wellsite surface. The drilling fluid returning to the surface may then be cleaned and again pumped through the drill string.

Mud pumps are typically reciprocating pumps comprising reciprocating fluid displacing members (e.g., pistons, plungers, diaphragms, etc.) driven by a crankshaft into and out of a fluid pressurizing chamber to alternatingly draw in, pressurize, and expel drilling fluid from the fluid pressurizing chamber. Each reciprocating member discharges the drilling fluid from its fluid pressurizing chamber in an oscillating manner, resulting in suction and discharge valves of the pumps alternatingly opening and closing during pumping operations. Each mud pump may comprise a prime mover (e.g., an engine or an electric motor) operable to drive (i.e., rotate) the crankshaft to facilitate the pumping operations. A gear train (e.g., a gear box or transmission) may be operatively connected between an output shaft of the prime mover and the crankshaft to transfer torque from the output shaft to the crankshaft. Several mud pumps may be connected in parallel to pump drilling fluid during drilling operations.

The gear train of each mud pump transfers high levels of mechanical power and torque during drilling operations, causing wear and degradation of the gear train. Such wear and degradation is often detected late, resulting in severe damage to the pump and/or pump failure. Pump failure during drilling operations may interrupt or lower efficiency of the drilling operations.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a system for monitoring operational health of a pump unit operable to pump a fluid. The pump unit includes a fluid pump, a gear train, and a prime mover operable to actuate the fluid pump via the gear train. The gear train is operatively connected between an output shaft of the prime mover and a crankshaft of the fluid pump. The system includes a rotational position sensor operable to facilitate rotational position measurements indicative of a rotational position of the output shaft, a locking device operable to mechanically engage the crankshaft such that the crankshaft cannot rotate, and a processing device having a processor and memory storing computer program code. The processing device is communicatively connected with the prime mover and the rotational position sensor. After the locking device mechanically engages the crankshaft such that the crankshaft cannot rotate, the processing device is operable to measure backlash of the gear train by: causing the prime mover to rotate the output shaft in a first direction until the output shaft reaches a first rotational position at which the output shaft cannot further rotate; causing the prime mover to rotate the output shaft in a second direction until the output shaft reaches a second rotational position at which the output shaft cannot further rotate; recording the rotational position measurements while the prime mover rotates the output shaft in the second direction from the first rotational position to the second rotational position; and determining backlash of the gear train by determining rotational distance between the first rotational position of the output shaft and the second rotational position of the output shaft based on the recorded rotational position measurements.

The present disclosure also introduces a method that includes commencing operation of a processing device to measure backlash of a gear train of a pump unit for pumping a fluid. The pump unit further includes a fluid pump and a prime mover operable to actuate the fluid pump via the gear train. The gear train is operatively connected between an output shaft of the prime mover and a crankshaft of the fluid pump. The processing device: receives rotational position measurements indicative of rotational position of the output shaft; causes the prime mover to rotate the output shaft in a first direction until the output shaft reaches a first rotational position at which the output shaft cannot further rotate; causes the prime mover to rotate the output shaft in a second direction until the output shaft reaches a second rotational position at which the output shaft cannot further rotate; records the rotational position measurements while the prime mover rotates the output shaft in the second direction from the first rotational position to the second rotational position; and determines backlash of the gear train by determining rotational distance between the first rotational position of the output shaft and the second rotational position of the output shaft based on the recorded rotational position measurements.

The present disclosure also introduces a locking device for a reciprocating pump operable to pump a fluid. The locking device is operable to engage a crankshaft of the reciprocating pump such that the crankshaft cannot rotate.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
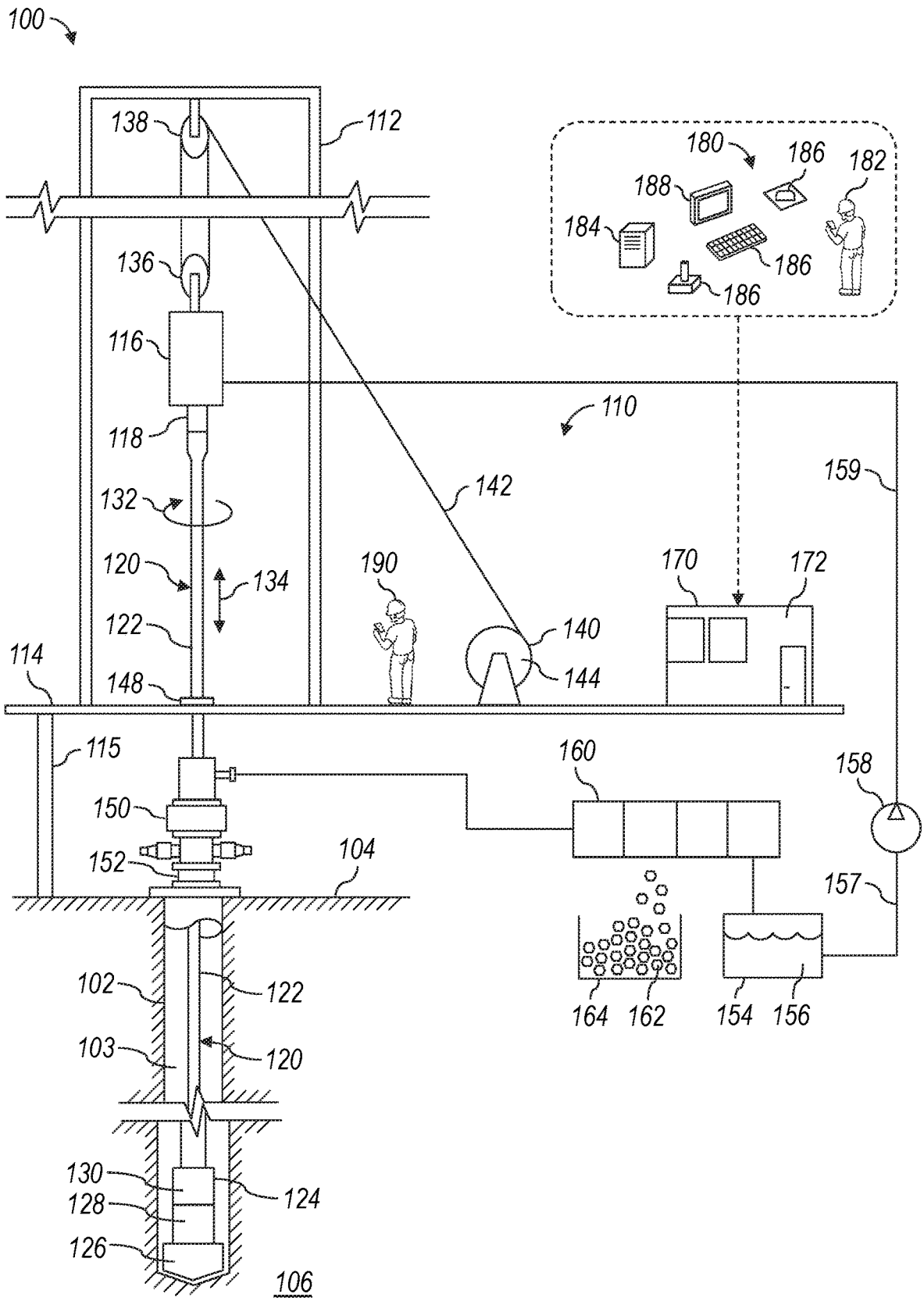
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a drilling rig and associated wellsite equipment collectively operable to construct (e.g., drill) a wellbore 102 extending from a wellsite surface 104 into a subterranean formation 106 via rotary and/or directional drilling. Although the well construction system 100 is depicted as an onshore implementation, the aspects described below are also applicable or readily adaptable to offshore implementations.

The well construction system 100 comprises well construction equipment, such as surface equipment 110 located at the wellsite surface 104 and a drill string 120 suspended within the wellbore 102. The surface equipment 110 may include a support structure 112 (e.g., a mast or derrick) disposed over a rig floor 114. The drill string 120 may be suspended within the wellbore 102 from the support structure 112. The support structure 112 and the rig floor 114 may be collectively supported over the wellbore 102 by support structures 115 (e.g., legs). The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. The BHA 124 may also include a downhole mud motor 128 and one or more downhole tools 130 connected above the drill bit 126.

Rotation of the drill bit 126 and the weight of the drill string 120 may collectively operate to form the wellbore 102. The drill string 120, including the drill bit 126, may be selectively rotated 132 by a top drive 116. The top drive 116 may comprise a drive shaft 118 configured for coupling with the upper end of the drill string 120. The top drive 116 may be selectively operated to rotate 132 the drive shaft 118 and the drill string 120 coupled with the drive shaft 118. The mud motor 128 may also or instead impart the rotational motion 132 to the drill bit 126 to form the wellbore 102.

The top drive 116 may be suspended from (supported by) the support structure 112 via a hoisting system operable to impart vertical motion 134 to the top drive 116 and the drill string 120 connected to the top drive 116. The hoisting system may comprise a traveling block 136, a crown block 138, and a drawworks 140 storing a flexible line 142 (e.g., a cable, a wire rope, etc.). The crown block 138 may be connected to, and thus supported by, the support structure 112, and the traveling block 136 may be connected to, and thus support, the top drive 116. The drawworks 140 may be mounted to the rig floor 114. The crown block 138 and traveling block 136 may each comprise pulleys or sheaves around which the flexible line 142 is reeved to operatively connect the crown block 138, the traveling block 136, and the drawworks 140. The drawworks 140 may comprise a drum 144 and an electric motor (not shown) operatively connected with and operable to rotate the drum 144. The drawworks 140 may selectively impart tension to the flexible line 142 to lift and lower the top drive 116, resulting in the vertical motion 134 of the top drive 116 and the drill string 120 when connected to the top drive 116. For example, the drum 144 may be rotated to reel in the flexible line 142, causing the traveling block 136 and the top drive 116 to move upward. The drum 144 may also be rotated to reel out the flexible line 142, causing the traveling block 136 and the top drive 116 to move downward. During drilling operations, rotation of the drill bit 126 caused by the top drive 116 and/or the mud motor 128, in conjunction with downward motion of the drill string 120 caused by the hoisting system, may advance the drill string 120 into the formation 106 to form the wellbore 102.

A set of slips 148 may be located on the rig floor 114 to accommodate the drill string 120 during drill string make up and break out operations, drill string running operations, and drilling operations. The slips 148 may be in an open position to permit advancement of the drill string 120 within the wellbore 102 by the hoisting system, such as during the drill string running operations and the drilling operations. The slips 148 may be in a closed position to clamp the upper end (e.g., the uppermost tubular) of the drill string 120 to thereby suspend and prevent advancement of the drill string 120 within the wellbore 102, such as during the make up and break out operations. The hoisting system may deploy the drill string 120 into the wellbore 102 through fluid control equipment 150 (e.g., a blowout preventer, a wing valve, a bell nipple, a rotating control device, etc.) for maintaining well pressure control and controlling fluid being discharged from the wellbore 102. The fluid control equipment 150 may be mounted on top of a wellhead 152 installed over the wellbore 102.

The well construction system 100 may further include a drilling fluid circulation system operable to circulate fluids between the surface equipment 110 and the drill bit 126 during drilling operations. For example, the drilling fluid circulation system may be operable to inject a drilling fluid from the wellsite surface 104 into the wellbore 102 via an internal fluid passage extending longitudinally through the drill string 120. The drilling fluid circulation system may comprise a pit, a tank, and/or other fluid container 154 holding the drilling fluid 156 (i.e., drilling mud) and one or more pump units 158 (i.e., mud pumps) operable to receive the drilling fluid 156 from the container 154 and pump the drilling fluid 156 through the top drive 116 and downhole through an internal passage (not shown) extending through the drill string 120. The pump units 158 may receive the drilling fluid 156 from the container 154 via a fluid conduit 157 (e.g., a suction line) and pump the drilling fluid to the top drive 116 via a fluid conduit 159 (e.g., a stand pipe).

During drilling operations, the drilling fluid may be pumped by the pump units 158 downhole through the drill string 120. The drilling fluid may exit the BHA 124 via ports in the drill bit 126 and then circulate uphole through an annular space 103 of the wellbore 102. In this manner, the drilling fluid lubricates the drill bit 126 and carries formation cuttings uphole to the wellsite surface 104. The drilling fluid flowing uphole toward the wellsite surface 104 may exit the wellbore 102 via one or more instances of the fluid control equipment 150. The drilling fluid may then pass through drilling fluid reconditioning equipment 160 to be cleaned and reconditioned before returning to the fluid container 154. The drilling fluid reconditioning equipment 160 may separate drill cuttings 162 from the drilling fluid into a cuttings container 164.

The well construction system 100 may also comprise a control center 170 from which various portions of the well construction system 100, such as the top drive 116, the hoisting system (e.g., the drawworks 140), a tubular handling system (e.g., a catwalk, a tubular handling device, etc.), the drilling fluid circulation system (e.g., the pump units 158), the drilling fluid cleaning and reconditioning system 160, a well control system (e.g., the fluid control equipment 150, a choke manifold, etc.), and the BHA 124, among other examples, may be monitored and controlled. The control center 170 may be located on the rig floor 114 or another location of the well construction system 100, such as the wellsite surface 104. The control center 170 may comprise a facility 172 (e.g., a room, a cabin, a trailer, etc.) containing a control workstation 180, which may be operated by rig personnel 182 (e.g., a driller or another human rig operator) to monitor and control various wellsite equipment or portions of the well construction system 100. However, certain pieces of the surface equipment 110 may also or instead be manually operated (e.g., by hand, via a local control panel, etc.) by rig personnel 190 (e.g., a roughneck) located at various portions (e.g., the rig floor 114) of the well construction system 100.

The control workstation 180 may comprise or be communicatively connected with an equipment controller 184 (e.g., a processing device, a computer, etc.), such as may be operable to receive, process, and output information to monitor operations of and/or provide control to one or more portions of the well construction system 100. For example, the equipment controller 184 may be communicatively connected with the various surface equipment 110 and/or downhole equipment (e.g., the BHA 124) described herein, among other examples, and may be operable to receive signals (e.g., sensor measurements and/or other data) from and transmit signals (e.g., control commands, signals, and/or other data) to the surface equipment 110 and/or downhole equipment to perform various operations, perhaps including at least a portion of one or more of the operations described herein. The equipment controller 184 may store executable program code, instructions, and/or operational parameters or set-points, including for implementing one or more aspects of the methods and operations described herein. The equipment controller 184 may be located within and/or outside of the facility 172.

The control workstation 180 may be operable for entering or otherwise communicating control commands to the equipment controller 184 by the rig personnel 182, and for displaying or otherwise communicating information from the equipment controller 184 to the rig personnel 182. The control workstation 180 may comprise one or more input devices 186 (e.g., a keyboard, a mouse, a joystick, a touchscreen, etc.) and one or more output devices 188 (e.g., a video monitor, a touchscreen, a printer, audio speakers, etc.). Communication between the equipment controller 184, the input and output devices 186, 188, and the various wellsite equipment may be via wired and/or wireless communication means. However, for clarity and ease of understanding, such communication means are not depicted, and a person having ordinary skill in the art will appreciate that such communication means are within the scope of the present disclosure.

Other implementations of the well construction system 100 within the scope of the present disclosure may include more or fewer components than as described above and/or depicted in FIG. 1. Additionally, various equipment and/or subsystems of the well construction system 100 shown in FIG. 1 may include more or fewer components than as described above and/or depicted in FIG. 1. For example, various engines, motors, hydraulics, actuators, valves, and/or other components not explicitly described herein may be included in the well construction system 100, and are within the scope of the present disclosure.

Backlash of operatively connected (e.g., meshing) gears (i.e., a gear train) may be measured and then used as a basis for determining operational health of such gears. Backlash, which may be referred to as lash or play, is a clearance or lost motion of operatively connected gears caused by gaps between teeth of the gears. Backlash of a gear train may be defined as the maximum distance through which a gear of the gear train can be moved in one direction without applying appreciable force or motion to the next gear in the mechanical sequence. Distance of motion may be linear or rotational (i.e., angular). Gear trains of wellsite equipment may comprise a multitude of operatively connected gears. Each connection has its own individual backlash and the sum of the individual backlashes yields a total backlash of the gear train.

Some of the wellsite equipment described above operate in a generally unidirectional manner. For example, pump units discharge drilling fluid while operating in one direction, a drawworks increases and decreases tension of a flexible line while operating in one direction, and a top drive drills a wellbore by rotating in one direction (i.e., clockwise). Although the top drive also rotates counterclockwise to perform certain operations (e.g., reaming, break out of connections, etc.), the total number of counterclockwise rotations pales in comparison to the total number of clockwise rotations performed to drill the wellbore. Because of such unidirectional operation, gear trains of unidirectional wellsite equipment experience loading and wear primarily on one side of their respective gear teeth. Accordingly, a distinction should be made between load side and non-load side when measuring backlash of unidirectional wellsite equipment. As a check on validity of backlash measurements used to determine operational health (e.g., progressive wear) of unidirectional wellsite equipment, it is to be observed that a load side backlash will generally be larger than a non-load side backlash. Backlash measurements of both load and non-load sides of a gear train provide value, in that the load side backlash is generally larger than the non-load side backlash, and that the non-load side backlash (and thus wear) generally increases slowly and progressively. The non-load backlash being larger than the load backlash may be indicative of an unusual operational health problem associated with a piece of unidirectional wellsite equipment. It is also expected that, over a longer period of time, the load backlash and the non-load backlash will further diverge.

The present disclosure is further directed to various implementations of systems and/or methods for measuring backlash of a gear train of a pump unit. The measured backlash may be received by a processing device and recorded. The systems and/or methods may be further operable to detect or determine operational health of the gear train based on the measured backlash. Operational health may include physical condition, such as a level or progression of wear, degradation, and/or deterioration of the gear train. The systems and/or methods may be operable to measure the backlash of the gear train based on sensor measurements indicative of operational parameters of the pump unit. For example, the backlash measurements may be based on rotational position measurements facilitated by a rotational position sensor located in association with the fluid pump. The backlash measurements may be determined during backlash measurement operations. The backlash measurements may be compared to a predetermined backlash threshold quantity to determine the operational health of the gear train.

Figure 2:
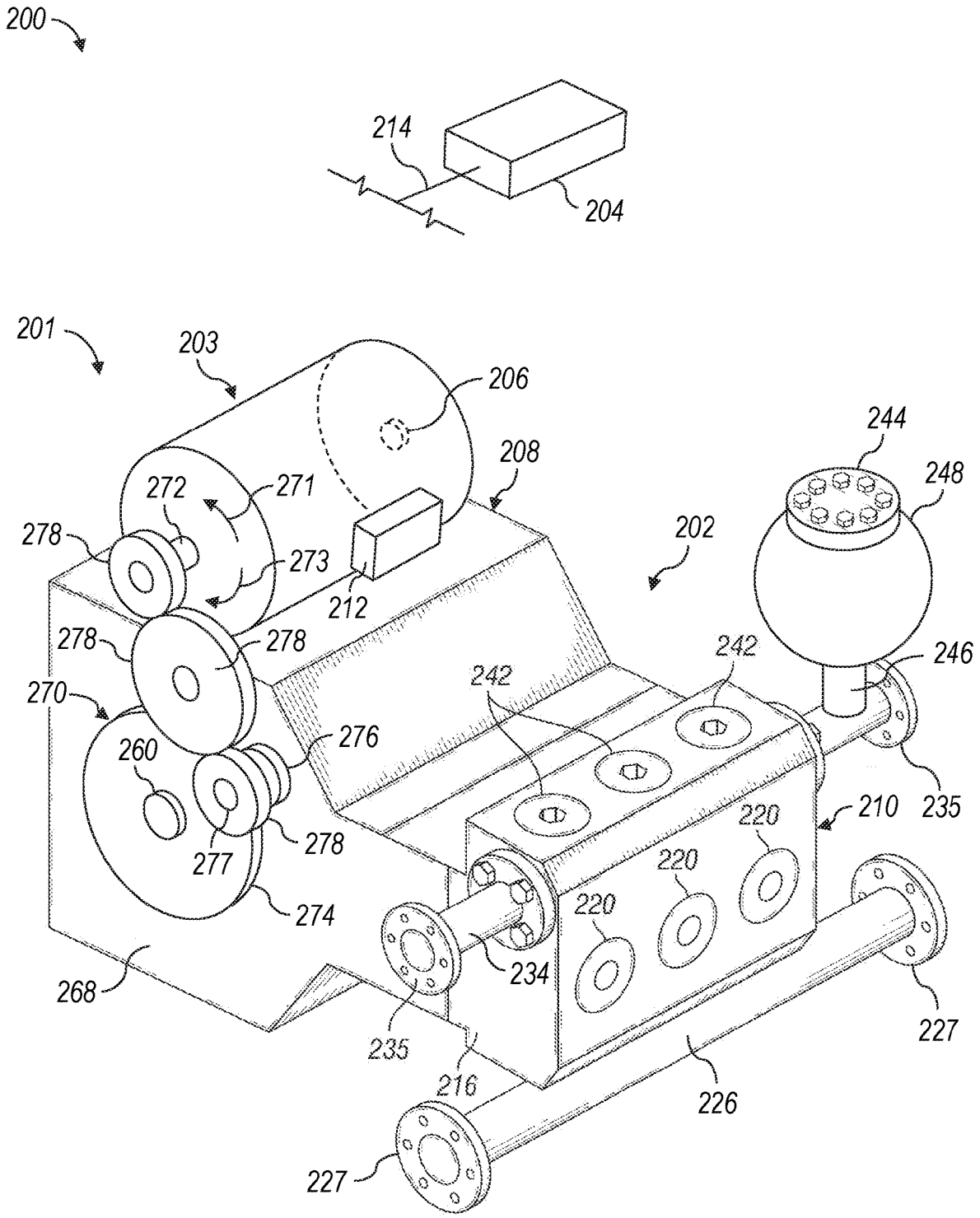
FIG. 2 is a perspective view of an example implementation of apparatus according to one or more aspects of the present disclosure.
Figure 3:
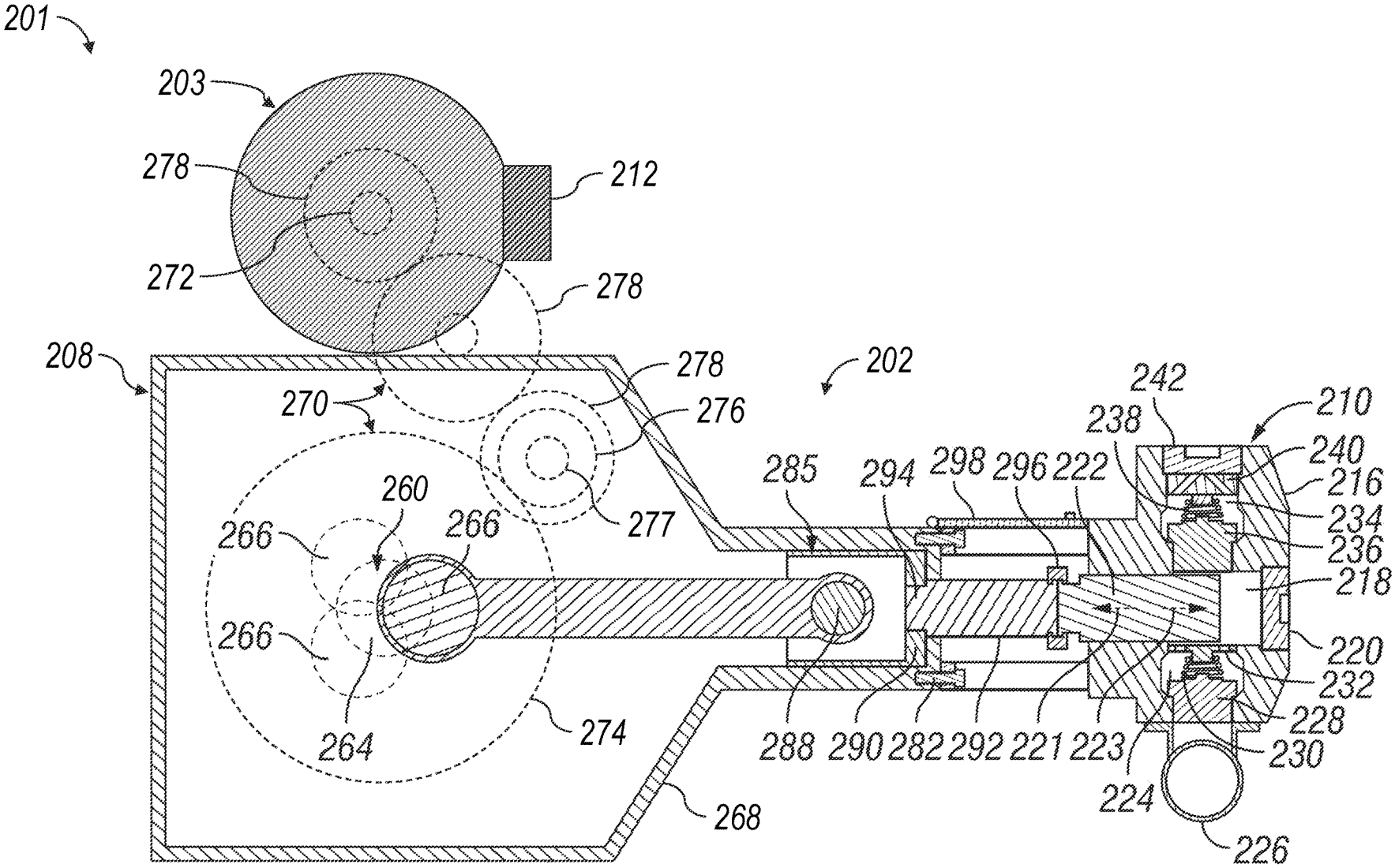
FIG. 3 is a side sectional view of the apparatus shown in FIG. 2.
Figure 4:
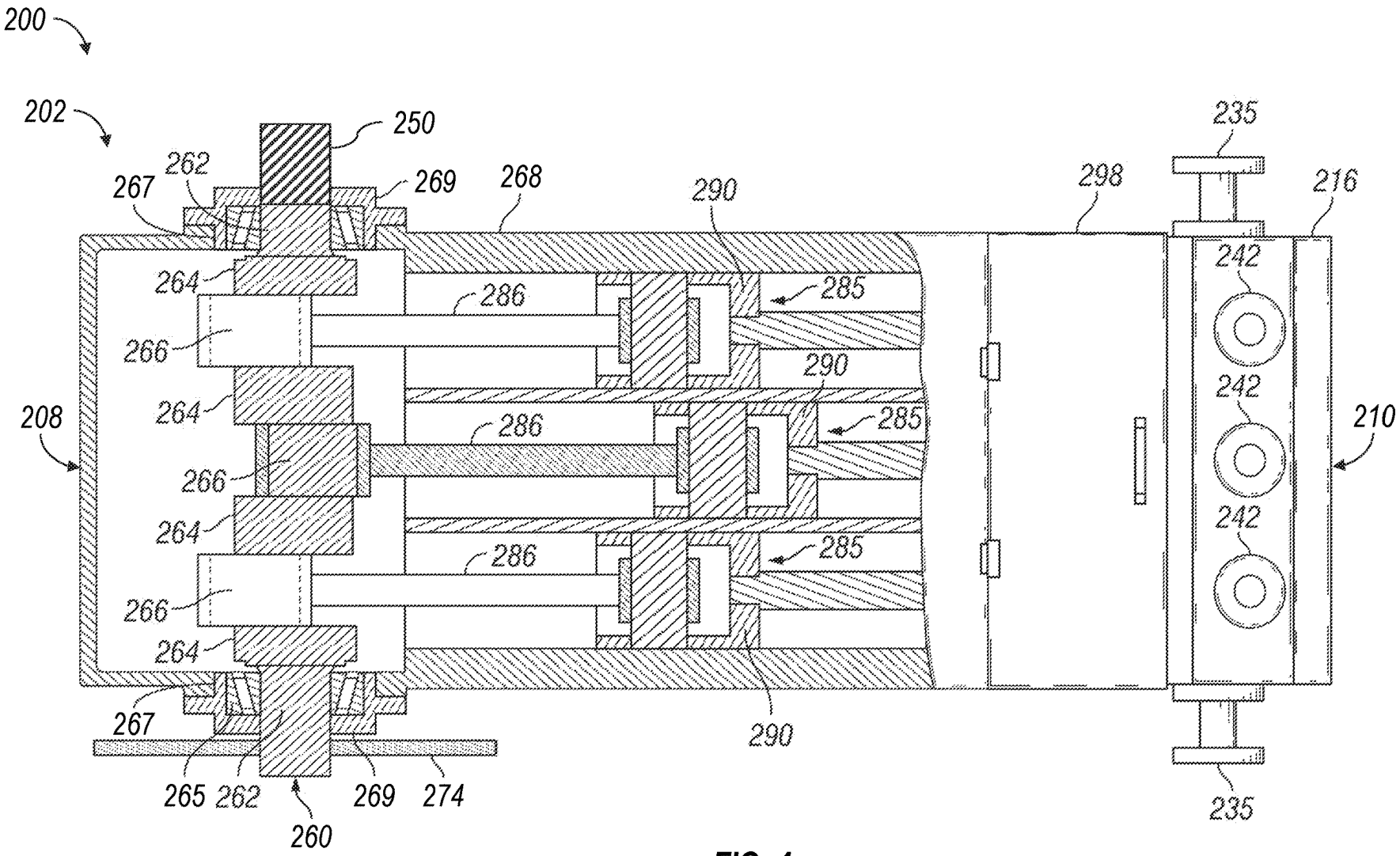
FIG. 4 is a top sectional view of the apparatus shown in FIG. 2.

FIGS. 2-4 are perspective, side sectional, and top sectional views, respectively, of at least a portion of an example implementation of a monitoring system 200 for measuring operational parameters associated with (e.g., experienced and/or generated by) a pump unit 201 and determining operational health of the pump unit 201 based on the measured operational parameters. Portions of the pump unit 201 are shown in phantom lines for clarity and/or to prevent obstruction from view of other portions of the pump unit 201. The monitoring system 200 may form a portion of or operate in conjunction with the well construction system 100 shown in FIG. 1. For example, the pump unit 201 may be or comprise an example implementation of an instance of the pump units 158 shown in FIG. 1. Accordingly, the following description refers to FIGS. 1-4, collectively.

The monitoring system 200 may comprise an equipment controller 204, such as a programmable logic controller (PLC), a computer (PC), an industrial computer (IPC), or another information processing device equipped with control logic, communicatively connected with various sensors and actuators of the pump unit 201 and/or of the monitoring system 200. The equipment controller 204 may be in real-time communication with such sensors and actuators and may be utilized to monitor and control various portions, components, and equipment of the pump unit 201. The equipment controller 204 may be, comprise, or form at least a portion of the processing device 184. Communication between the equipment controller 204 and the sensors and actuators may be via wired and/or wireless communication means 214. However, for clarity and ease of understanding, such communication means 214 are not wholly depicted, and a person having ordinary skill in the art will appreciate that such communication means are within the scope of the present disclosure.

The pump unit 201 comprises a fluid pump 202 operatively connected with and actuated by a prime mover 203. The fluid pump 202 includes a power section 208 (i.e., a crankcase) and a fluid section 210. The fluid section 210 may comprise a fluid end module 216 (e.g., block, housing, etc.) having a plurality of fluid pressurizing chambers 218. One end of each fluid pressurizing chamber 218 may be plugged by a cover plate 220, such as may be threadedly engaged with the fluid end module 216, and an opposite end of each fluid pressurizing chamber 218 may contain a reciprocating fluid displacing member 222 slidably disposed therein and operable to displace the fluid within the corresponding fluid pressurizing chamber 218. During pumping operations, the prime mover 203 rotates a portion of the power section 208 of the pump unit 201 in a manner that generates a reciprocating linear motion to longitudinally oscillate, reciprocate, or otherwise move each fluid displacing member 222 within the corresponding fluid pressurizing chamber 218. Although the fluid displacing member 222 is depicted as a plunger, the fluid displacing member 222 may also be implemented as a piston, diaphragm, or another reciprocating fluid displacing member.

Each fluid pressurizing chamber 218 comprises or is fluidly connected with a corresponding fluid inlet cavity 224 configured for communicating fluid from a common fluid inlet 226 (e.g., an inlet manifold or a suction manifold) into the fluid pressurizing chamber 218. The fluid inlet 226 may comprise or terminate with one or more fluid connectors 227, each of which may be fluidly connected with a source of drilling fluid, such as the fluid container 154 via the fluid conduit 157. An inlet (i.e., suction) valve 228 may selectively fluidly isolate each fluid pressurizing chamber 218 from the fluid inlet 226 to selectively control fluid flow from the fluid inlet 226 into each fluid pressurizing chamber 218. Each inlet valve 228 may be disposed within a corresponding fluid inlet cavity 224 or otherwise between each fluid inlet cavity 224 and the corresponding fluid pressurizing chamber 218. Each inlet valve 228 may be biased toward a closed flow position by a spring or another biasing member 230, which may be held in place by an inlet valve stop 232. Each inlet valve 228 may be actuated to an open flow position by a predetermined differential pressure between the corresponding fluid pressurizing chamber 218 and the fluid inlet 226. Each fluid pressurizing chamber 218 may be fluidly connected with a common fluid outlet 234 (e.g., outlet manifold or discharge manifold).

The fluid outlet 234 may be or comprise a fluid cavity extending through the fluid end module 216 transverse to the fluid cambers 218. The fluid outlet 234 may comprise or terminate with one or more fluid connectors 235, each of which may be fluidly connected with the fluid conduit 159 to fluidly connect the fluid outlet 234 with the top drive 116.

An outlet (i.e., discharge) valve 236 may selectively fluidly isolate each fluid pressurizing chamber 218 from the fluid outlet 234 to selectively control fluid flow from each fluid pressurizing chamber 218 into the fluid outlet 234. Each outlet valve 236 may be disposed within the fluid outlet 234 or otherwise between each fluid pressurizing chamber 218 and the fluid outlet 234. Each outlet valve 236 may be biased toward a closed flow position by a spring or another biasing member 238, which may be held in place by an outlet valve stop 240. Each outlet valve 236 may be actuated to an open flow position by a predetermined differential pressure between the corresponding fluid pressurizing chamber 218 and the fluid outlet 234. The fluid outlet 234 may be plugged by cover plates 242, such as may be threadedly engaged with the fluid end module 216.

During pumping operations, the prime mover 203 may cause the reciprocating linear motion of each fluid displacing member 222 within the corresponding fluid pressurizing chamber 218 to alternatingly decrease and increase pressure within each chamber 218, thereby alternatingly receiving (e.g., drawing) the fluid into and discharging (e.g., displacing) the fluid out of each fluid pressurizing chamber 218. With regard to each fluid displacing member 222, while the fluid displacing member 222 moves out of the fluid pressurizing chamber 218, as indicated by arrow 221 (FIG. 3), the pressure of the fluid inside the corresponding fluid pressurizing chamber 218 decreases, thus creating a differential pressure across the corresponding fluid inlet valve 228. The pressure differential operates to compress the biasing member 230, thus actuating the fluid inlet valve 228 to an open flow position to permit the fluid from the fluid inlet 226 to be drawn into or otherwise enter a fluid pressurizing chamber 218 via a corresponding fluid inlet cavity 224. The fluid enters the fluid pressurizing chamber 218 from the fluid inlet 226 while the fluid displacing member 222 continues to move longitudinally out of the fluid pressurizing chamber 218, as indicated by the arrow 221. When the fluid displacing member 222 reaches end of stroke and reverses direction, as indicated by the arrow 223, the fluid pressure within the fluid pressurizing chamber 218 increases above the fluid pressure within the fluid inlet 226, thereby permitting the biasing member 230 to actuate the fluid inlet valve 228 to the closed flow position. When the fluid displacing member 222 begins to move longitudinally back into the fluid pressurizing chamber 218, as indicated by arrow 223, the pressure of the fluid inside of fluid pressurizing chamber 218 begins to increase. The fluid pressure inside the fluid pressurizing chamber 218 continues to increase while the fluid displacing member 222 continues to move into the fluid pressurizing chamber 218 until the pressure of the fluid inside the fluid pressurizing chamber 218 is high enough to overcome the pressure of the fluid inside the fluid outlet 234 and compress the biasing member 238, thus actuating the fluid outlet valve 236 to the open flow position and permitting the pressurized fluid to move into the fluid outlet 234 and then out of the fluid outlet 234 and to the top drive 116 via the fluid conduit 159 fluidly connected with the fluid connectors 235.

The fluid flow rate generated by the pump unit 201 may depend on the physical size of the fluid displacing members 222 and fluid pressurizing chambers 218, as well as the pump unit operating speed, which may be defined by the speed or rate at which the fluid displacing members 222 reciprocate or otherwise alternatingly move into and out of the fluid pressurizing chambers 218. The pumping speed, such as the speed or the rate at which the fluid displacing members 222 move, may be related to the rotational speed of the power section 208 and/or the prime mover 203. Accordingly, the fluid flow rate generated by the pump unit 201 may be controlled by controlling the rotational speed of the power section 208 and/or the prime mover 203.

The prime mover 203 may comprise an engine (such as a gasoline engine or a diesel engine), an electric motor (such as a synchronous or asynchronous electric motor, including a synchronous permanent magnet motor), a hydraulic motor, or another prime mover operable to drive or otherwise rotate a crankshaft 260 of the power section 208 to cause the reciprocating linear motion of each fluid displacing member 222 within the corresponding fluid pressurizing chamber 218. The crankshaft 260 may be enclosed and maintained in position by a power section housing 268. The housing 268 and the prime mover 203 may be fixedly connected together or to a common base, such as a skid or mobile trailer, to prevent relative rotation between the housing 268 and the prime mover 203.

The crankshaft 260 may comprise a plurality of support journals 262, axial journals 264, and offset journals 266. The support journals 262 and axial journals 264 may extend along a central axis of rotation of the crankshaft 260, and the offset journals 266 may be offset from the central axis of rotation by a distance and spaced 120 degrees apart with respect to the support journals 262 and the axial journals 264. The crankshaft 260 may be supported in position within the power section 208 by the power section housing 268, wherein the support journals 262 may extend through opposing openings 267 in the power section housing 268. One or more bearings 265 may be disposed about the support journals 262 and against the side surfaces of the openings 267 to facilitate rotation of the crankshaft 260 within the housing 268. A cover plate 269 and/or other means for protection may enclose the bearings 265 and the crankshaft 260.

Operational control of the prime mover 203 may be facilitated by a prime mover controller 212, which may be or comprise a variable frequency drive (VFD) and/or an engine throttle control. The VFD and/or throttle control may be connected with or otherwise be in communication with the prime mover 203 via mechanical and/or electrical communication means (not shown). The controller 212 may include the VFD in implementations in which the prime mover 203 is or comprises an electric motor. The controller 212 may include the engine throttle control in implementations in which the prime mover 203 is or comprises an engine.

For example, the VFD may receive control signals from the equipment controller 204 and output corresponding electrical power to control the speed and the torque output of the prime mover 203, thus controlling the pumping speed and fluid flow rate of the pump unit 201, as well as the maximum pressure generated by the fluid pump 202. The throttle control may receive control signals from the equipment controller 204 and output a corresponding electric or mechanical throttle control signal to control the speed of the prime mover 203 to control the pumping speed, and thus the fluid flow rate, generated by the fluid pump 202. Although the controller 212 is shown located near or in association with the prime mover 203, the controller 212 may be located at a distance from the prime mover 203. For example, the controller 212 may be implemented as part of the equipment controller 204 and/or located within the facility 172.

A gear train 270 may operatively (i.e., mechanically) connect an output shaft 272 of the prime mover 203 with the crankshaft 260 of the fluid pump 202 to facilitate transfer of torque from the prime mover 203 to the crankshaft 260. The gear train 270 may comprise a spur gear 274 coupled or integrally formed with the crankshaft 260 and a pinion gear 276 coupled or integrally formed with a pinion shaft 277 supporting the pinion gear 276. At least a portion of the pinion shaft 277 may be enclosed and maintained in position by the power section housing 268. The gear train 270 may further comprise additional gears 278 operatively connecting the output shaft 272 with the pinion shaft 277. For example, the gears 278 may comprise a first gear 278 coupled with the output shaft 272, a second gear 278 coupled with the pinion shaft 277, and a third gear 278 operatively connecting the first and second gears 278. The gears 278 may be or form at least a portion of a gear box or transmission operatively connecting the output shaft 272 with the pinion shaft 277. Thus, the gears 278 may transfer torque from the output shaft 272 of the prime mover 203 to the pinion shaft 277, and the gears 274, 276 may further transfer such torque from the pinion shaft 277 to the crankshaft 260. A cover plate and/or other means for protection (not shown) may enclose the gears 274, 276, 278. Although the spur gear 274 and the pinion gear 276 are shown located outside (i.e., on a side) of the housing 268, the spur gear 274 and the pinion gear 276 may instead be located within the housing 268. For example, the spur gear 274 may be coupled or integrally formed with an intermediate potion the crankshaft 260, and the pinion gear 276 may be coupled or integrally formed with an intermediate potion the pinion shaft 277.

A plurality of crosshead mechanisms 285 may be utilized to transform and transmit the rotational motion of the crankshaft 260 to a reciprocating linear motion of the fluid displacing members 222. For example, each crosshead mechanism 285 may comprise a connecting rod 286 pivotally coupled with a corresponding offset journal 266 at one end and with a pin 288 of a crosshead 290 at an opposing end. During pumping operations, walls and/or interior portions of the power section housing 268 may guide each crosshead 290, such as may prevent or inhibit lateral motion of each crosshead 290. Each crosshead mechanism 285 may further comprise a piston rod 292 coupling the crosshead 290 with the fluid displacing member 222. The piston rod 292 may be coupled with the crosshead 290 via a threaded connection 294 and with the fluid displacing member 222 via a flexible connection 296.

The power section 208 and the fluid section 210 may be coupled or otherwise connected together. For example, the fluid end module 216 may be fastened with the power section housing 268 by a plurality of threaded fasteners 282. The fluid pump 202 may further comprise an access door 298, which may facilitate access to portions (e.g., the crosshead mechanisms 285) of the fluid pump 202 located between the power section 208 and the fluid section 210, such as during assembly and/or maintenance of the fluid pump 202.

The pump unit 201 may comprise a pressure pulsation dampener 244 (shown just in FIG. 2), which may be fluidly connected with or along the fluid outlet 234 of the fluid pump 202 to dissipate or otherwise reduce magnitude (i.e., amplitude) of the pressure pulsations (i.e., fluctuations) within the drilling fluid discharged from the fluid pump 202. The pulsation dampener 244 may comprise a pressure vessel 248 having an internal chamber containing a gas-charged bladder (not shown) and fluid port 246 through which the internal chamber may receive the drilling fluid being discharged via the fluid outlet 234.

The monitoring system 200 may further comprise a rotational position sensor 206 operable to facilitate rotational (i.e., angular) position measurements indicative of the rotational position of the output shaft 272 of the prime mover 203. For example, the rotational position sensor 206 may output a sensor signal or information that is indicative of (or otherwise operable to facilitate determination of) the rotational position of the output shaft 272. The rotational position sensor 206 may be operatively connected with and/or disposed in association with the prime mover 203. For example, the rotational position sensor 206 may be disposed or installed in association with the output shaft 272 or another rotating portion of the prime mover 203. At least a portion of the rotational position sensor 206 may be in communication with, operatively connected to, or in physical contact with the output shaft 272 or another rotating portion of the prime mover 203. The rotational position sensor 206 may be operable to convert rotational position or motion of the output shaft 272 to an electrical signal indicative of the rotational position of the output shaft 272. The rotational position measurements facilitated by the rotational position sensor 206 may be further indicative of rotational distance, rotational speed, and rotational acceleration of the output shaft 272. The rotational position sensor 206 may be or comprise, for example, a rotary encoder, a rotary potentiometer, and/or a rotary variable-differential transformer (RVDT).

The equipment controller 204 may be operable to monitor and control various operational parameters of the pump unit 201. The equipment controller 204 may be in communication with the rotational position sensor 206 to facilitate monitoring of the rotational position, rotational distance, rotational speed, and rotational acceleration of the output shaft 272 of the prime mover 203. The equipment controller 204 may also be in communication with the prime mover 203 via the VFD of the controller 212 if the prime mover 203 is an electric motor, or via the throttle control of the controller 212 if the prime mover 203 is an engine, such as may permit the equipment controller 204 to activate, deactivate, and control the operational speed of the output shaft 272 of the fluid pump 202, as well as to control the flow rate and pressure generated by the fluid pump 202.

The monitoring system 200 may further comprise a locking device 250 (shown just in FIG. 4) operable to mechanically engage the crankshaft 260 of the fluid pump 202 such that the crankshaft 260 cannot rotate with respect to the housing 268 of the fluid pump 202. The locking device 250 may be disposed adjacent to or otherwise in association with the crankshaft 260. The locking device 250 may be directly or indirectly mounted or otherwise connected to the housing 268. For example, the locking device 250 may be mounted to the cover plate 269, which is mounted to the housing 268. The locking device 250 may extend through the cover plate 269, such that the locking device 250 can mechanically engage the crankshaft 260. The crankshaft 260 (e.g., a portion of a support journal 262 of the crankshaft 260) may extend through the cover plate 269, such that the locking device 250 can mechanically engage the crankshaft 260. The locking device 250 may be movable between a first position in which at least a portion of the locking device 250 does not engage the crankshaft 260, thereby permitting the crankshaft 260 to rotate, and a second position in which the at least a portion of the locking device 250 engages the crankshaft 260 such that the crankshaft 260 cannot rotate. In its second position, the locking device 250 may lock, latch, or otherwise connect the crankshaft 260 directly or indirectly to the housing 268 such that the crankshaft 260 cannot rotate with respect to the housing 268. For example, in its second position, the locking device 250 may latch the crankshaft 260 to the cover plate 269, which is connected to the housing 268.

Figure 5:
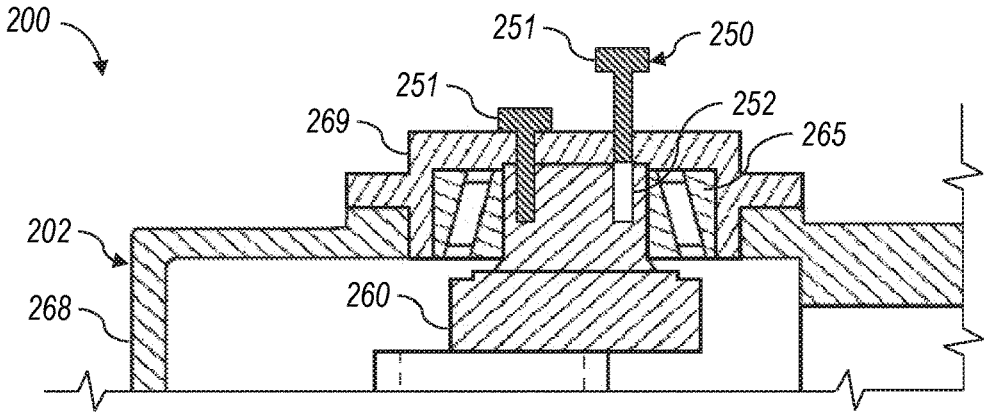
FIGS. 5-7 are enlarged views of example implementations of the apparatus shown in FIG. 4.
Figure 6:
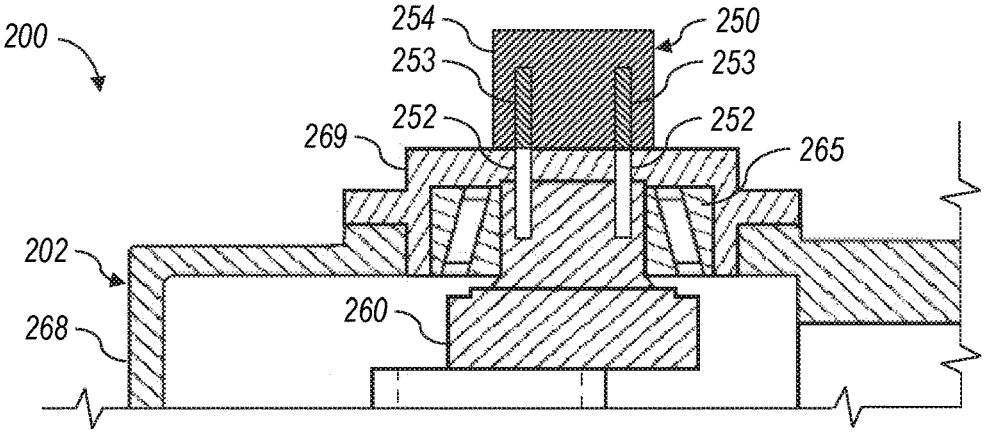
Figure 7:
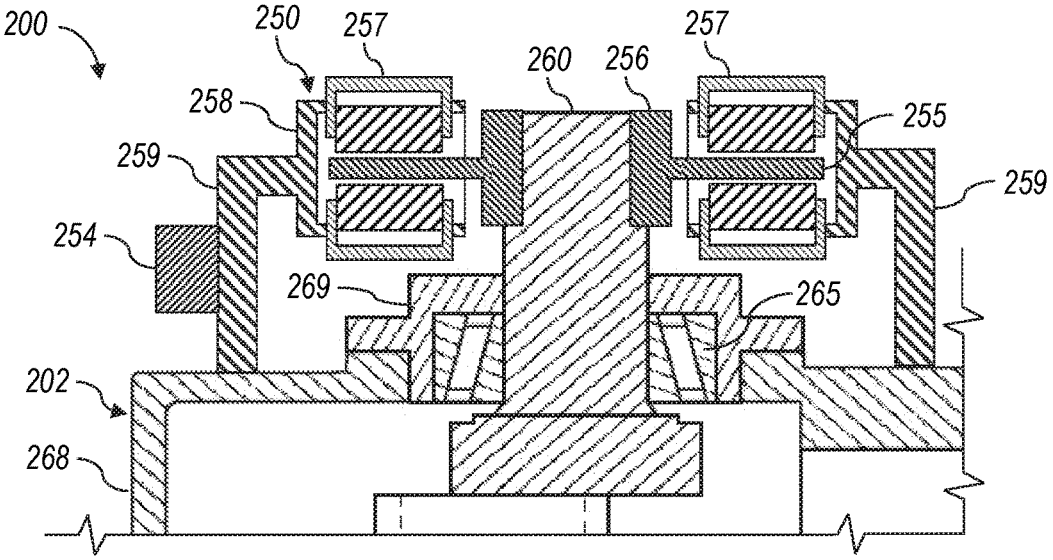

FIGS. 5-7 show example implementations of the locking device 250 shown in FIG. 4. FIG. 5 shows the locking device 250 implemented as a manually operated locking device 250 comprising a plurality of latches 251 operable to mechanically engage the crankshaft 260 such that the crankshaft 260 cannot rotate with respect to the housing 268. Each latch 251 may be movable within a bore 252 (e.g., a cavity) extending through the cover plate 269 and into the crankshaft 260 to mechanically engage the crankshaft 260.

For example, each latch 251 may be movable between a first position in which the latch 251 is not disposed within the bore 252 of the crankshaft 260, thereby permitting the crankshaft 260 to rotate, and a second position in which the latch 251 is disposed within the bore 252 of the crankshaft 260 to mechanically latch the crankshaft 260 to the housing 268 such that the crankshaft 260 cannot rotate. In their second position, the latches 251 mechanically latch the crankshaft 260 to the cover plate 269, which is connected to the housing 268, thereby indirectly latching the crankshaft 260 to the housing 268. The latches 251 may be implemented as pins, bolts, keys, or other members operable to latch the crankshaft 260 to the cover plate 269 or otherwise to the housing 268 such that the crankshaft 260 cannot rotate.

FIG. 6 shows the locking device 250 implemented as a remotely operable locking device 250. The locking device 250 may be remotely operated by the equipment controller 204 to move between a first position in which the locking device 250 does not engage the crankshaft 260, thereby permitting the crankshaft 260 to rotate, and a second position in which the locking device 250 engages the crankshaft 260 such that the crankshaft 260 cannot rotate. The locking device 250 may comprise one or more latches 253 and an actuator 254 operatively connected with and operable to move the latches 253. The actuator 254 may be communicatively connected with the equipment controller 204. Each latch 253 may be movable through a bore 252 extending through the cover plate 269 and into the crankshaft 260 to mechanically engage the crankshaft 260.

For example, the actuator 254 may be operable to receive control signals from the equipment controller 204 to cause the actuator 254 to move the latches 253 between a first position in which the latches 253 are not disposed within a corresponding bore 252 of the crankshaft 260, thereby permitting the crankshaft 260 to rotate, and a second position in which the latches 253 are disposed within the bore 252 of the crankshaft 260 to mechanically latch the crankshaft 260 to the housing 268 such that the crankshaft 260 cannot rotate. In their second position, the latches 251 mechanically latch the crankshaft 260 to the cover plate 269, which is connected to the housing 268, thereby indirectly latching the crankshaft 260 to the housing 268. Each latch 253 may be implemented as a pin, a bolt, a key, a rod of a piston/rod assembly of a pneumatic or hydraulic cylinder, or another member operable to latch the crankshaft 260 such that the crankshaft 260 cannot rotate. The actuator 254 may be implemented as an electric motor, an electromagnetic coil, a pneumatic flow control valve, or another remotely controlled actuator operable to move one or more of the latches 253 between their first and second positions.

FIG. 7 shows the locking device 250 implemented as a remotely operable brake system operable to mechanically engage the crankshaft 260 such that the crankshaft 260 cannot rotate with respect to the housing 268. The brake system may be disposed adjacent to or otherwise in association with the crankshaft 260. The brake system may be directly or indirectly mounted or otherwise connected to the housing 268. The brake system may be operable by the equipment controller 204 to move between a first position in which the brake system does not engage the crankshaft 260, thereby permitting the crankshaft 260 to rotate, and a second position in which the brake system engages the crankshaft 260 such that the crankshaft 260 cannot rotate.

The brake system may comprise a brake disc 255 (e.g., brake plate or rotor) connected with the crankshaft 260 extending out of the housing 268. The brake disc 255 may be integrally formed with the crankshaft 260 or the brake disc 255 may be connected with the crankshaft 260 via a hub 256. The hub 256 may be fixedly connected with the crankshaft 260 via interference fit (as depicted), complementary splines or threads, and/or fasteners (e.g., bolts).

The brake system may comprise a plurality of brake assemblies 257, each operable to apply a braking force to the brake disc 255 to lock the crankshaft 260. Each brake assembly 257 may comprise a piston (or ram) disposed within a corresponding cylinder. The brake assemblies 257 may be distributed on opposing sides of the brake disc 255, thereby permitting the braking force to be applied on opposing sides of the brake disc 255.

The brake system may further comprise one or more calipers 258 configured to maintain or support the brake assemblies 257 in position adjacent to the brake disc 255. Each caliper 258 may be or comprise a beam or frame extending along and/or partially around the brake disc 255. Each caliper 258 and the associated brake assemblies 257 may be fixedly connected to the housing 268 via a connecting member 259 (e.g., a frame, a mounting bracket, etc.). The connecting member 259 may be welded, bolted, or otherwise fixedly connected to the housing 268.

Each brake assembly 257 may be fluidly connected to a source of pressurized fluid (e.g., air, hydraulic fluid, etc.) via an actuator 254 (e.g., a fluid flow control valve). The actuator 254 may be operable to receive control signals from the equipment controller 204 to cause the actuator 254 to introduce the pressurized fluid to each brake assembly 257, thereby causing each brake assembly 257 to engage the brake disc 255 (and thus indirectly engage the crankshaft 260) such that the crankshaft 260 cannot rotate. The equipment controller 204 may thus cause the brake system to move each brake assembly 257 between a first position in which the brake assemblies 257 do not engage the brake disc 255, thereby permitting the crankshaft 260 to rotate, and a second position in which the brake assemblies engage the brake disc 255 to mechanically latch the crankshaft 260 to the housing 268 such that the crankshaft 260 cannot rotate.

Although FIGS. 2-7 show the fluid pump 202 implemented as a triplex reciprocating fluid pump, which has three fluid pressurizing chambers 218 and three fluid displacing members 222, implementations of the monitoring system 200 within the scope of the present disclosure may be utilized to monitor operational health of other pumps, such as a quintuplex reciprocating pump having five fluid pressurizing chambers 218, five sets of inlet and outlet valves 228, 236, and five fluid displacing members 222, or a pump having other quantities of fluid pressurizing chambers 218, inlet and outlet valves 228, 236, and fluid displacing members 222. It is further noted that the fluid pump 202 described above and shown in FIGS. 2-7 is merely an example, and that other pumps, such as diaphragm pumps, gear pumps, external circumferential pumps, internal circumferential pumps, lobe pumps, and other positive displacement pumps may also be monitored by the monitoring system 200.

As described above and shown in FIG. 1, systems (e.g., the monitoring system 200) and methods (e.g., steps, processes, operations, etc.) according to one or more aspects of the present disclosure may be utilized or otherwise implemented in association with a well construction system (e.g., the well construction system 100) at an oil and gas wellsite, such as for constructing a wellbore to obtain hydrocarbons (e.g., oil and/or gas) from a subterranean formation. However, one or more aspects of the present disclosure may be utilized or otherwise implemented in association with other automated systems in the oil and gas industry and other industries. For example, one or more aspects of the present disclosure may be implemented in association with wellsite systems for performing fracturing, cementing, acidizing, chemical injecting, and/or water jet cutting operations, among other examples. One or more aspects of the present disclosure may also be implemented in association with mining sites, building construction sites, and/or other work sites where automated machines or equipment are utilized.

Therefore, it is to be understood that the pump unit 201 may be utilized for pumping various fluids during various operations. As described above and shown in FIG. 1, the pump unit 201 may be utilized to pump a drilling fluid during well drilling operations. However, the pump unit 201 may instead be utilized to pump a fracturing fluid during well fracturing operations. The pump unit 201 may instead be utilized to pump a cement slurry during well cementing operations. The pump unit 201 may instead be utilized to pump an acid or other liquid chemicals during chemical injection or other stimulation operations. The pump unit 201 may instead be utilized to pump water or another aqueous solution during water jet cutting operations.

Figure 8:
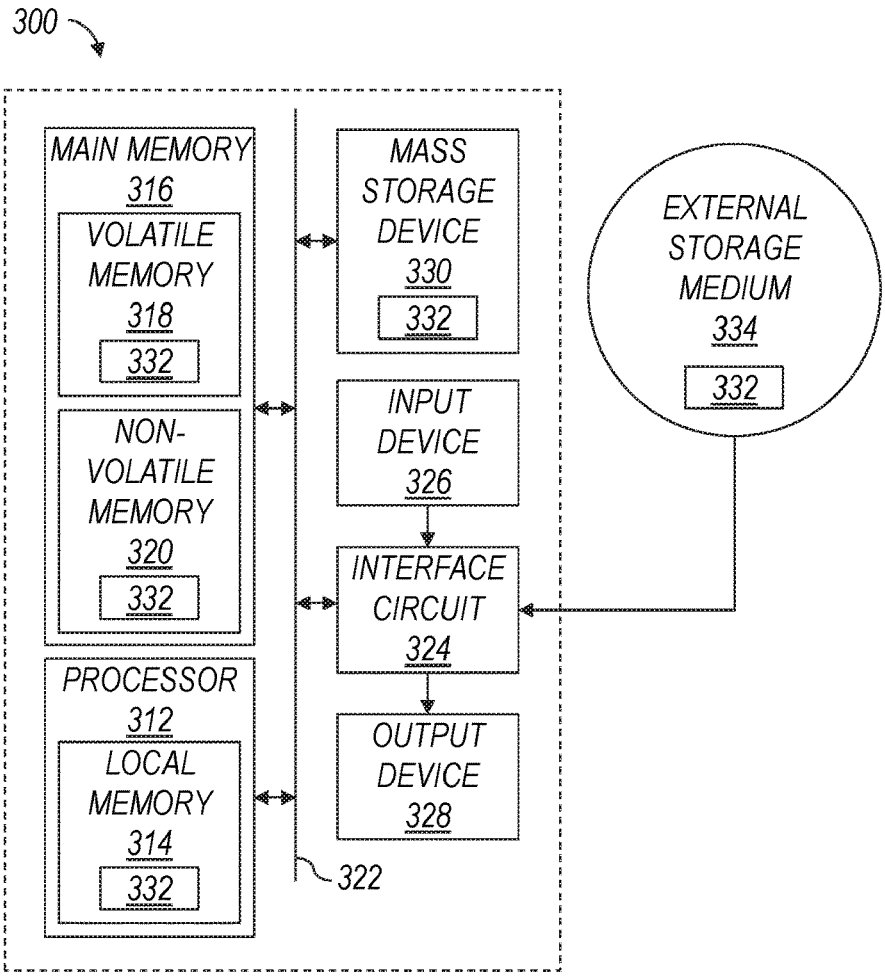
FIG. 8 is a schematic view of at least a portion of an example implementation of apparatus according to one or more aspects of the present disclosure.

FIG. 8 is a schematic view of at least a portion of an example implementation of a processing device 300 (or system) according to one or more aspects of the present disclosure. The processing device 300 may be or form at least a portion of one or more processing devices, equipment controllers, and/or other electronic devices shown in one or more of the FIGS. 1-7. Accordingly, the following description refers to FIGS. 1-8, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 300 may be or form at least a portion of the equipment controllers 184, 204. The processing device 300 may be or form at least a portion of a local equipment controller, such as the controller 212. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314, and may execute machine-readable and executable program code instructions 332 (i.e., computer program code) recorded in the local memory 314 and/or another memory device. The processor 312 may execute, among other things, the program code instructions 332 and/or other instructions and/or programs to implement the example methods, processes, and/or operations described herein. For example, the program code instructions 332, when executed by the processor 312 of the processing device 300, may cause the monitoring system 200 to perform the example methods and/or operations described herein. The program code instructions 332, when executed by the processor 312 of the processing device 300, may also or instead cause the processor 312 to receive, record, and process (e.g., analyze) sensor data (e.g., sensor measurements), compare the sensor data, and output data and/or information indicative of backlash and/or operational health the pump units 158, 201.

The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit rig personnel 182, 190 to enter the program code instructions 332, which may be or comprise control commands, operational parameters, pumping operations, operational health thresholds, and/or other operational set-points. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit for visualization or other sensory perception of various data, such as sensor data, status data, and/or other example data. The output devices 328 may be, comprise, or be implemented by video output devices (e.g., a liquid crystal display (LCD), a light-emitting diode (LED) display, a cathode ray tube (CRT) display, a touchscreen, etc.), printers, and/or speakers, among other examples. The one or more input devices 326 and the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a hard disk drive, a compact disk (CD) drive, and/or a digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 and other data (e.g., sensor data or measurements database) may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to example methods (e.g., step, operations, processes, etc.) of performing operational health monitoring of a pump unit, such as the pump unit 201, via a monitoring system, such as the monitoring system 200. The example methods may be performed utilizing or otherwise in conjunction with at least a portion of one or more implementations of one or more instances of the apparatus shown in one or more of FIGS. 1-8 and/or otherwise within the scope of the present disclosure. For example, the methods may be performed and/or caused at least partially by a processing device, such as the processing device 300 executing program code instructions 332 according to one or more aspects of the present disclosure. The methods may also or instead be performed and/or caused at least partially by a human wellsite operator (i.e., rig personnel) utilizing one or more instances of the apparatus shown in one or more of FIGS. 1-8 and/or otherwise within the scope of the present disclosure. Thus, the following description of an example method refers to apparatus shown in one or more of FIGS. 1-8. However, the method may also be performed in conjunction with implementations of apparatus other than those depicted in FIGS. 1-8 that are also within the scope of the present disclosure. The following description refers to FIGS. 1-8, collectively.

An example method according to one or more aspects of the present disclosure may comprise locking the crankshaft 260 of the pump unit 201, such that the crankshaft 260 cannot rotate, and then operating a processing device 300 to measure backlash of the gear train 270 of the pump unit 201. The crankshaft 260 may be locked by using or otherwise operating the locking device 250 to mechanically engage the crankshaft 260 such that the crankshaft 260 cannot rotate.

The locking device 250 may be operated manually by rig personnel to move the locking device 250 from a first position in which the locking device 250 does not engage the crankshaft 260, thereby permitting the crankshaft 260 to rotate, to a second position in which the locking device 250 engages the crankshaft 260 such that the crankshaft 260 cannot rotate. For example, the rig personnel may move the latch 251 of the locking device 250 from a first position in which the latch 251 does not engage the crankshaft 260, thereby permitting the crankshaft 260 to rotate, to a second position in which the latch 251 engages the crankshaft 260 to mechanically latch the crankshaft 260 to the housing 268 such that the crankshaft 260 cannot rotate. However, the locking device 250 may be operated remotely by the processing device 300 to move the locking device 250 from the first position to the second position. For example, the processing device 300 may cause the actuator 254 to move the latch 251 from the first position to the second position.

After the locking device 250 mechanically engages the crankshaft 260 such that the crankshaft 260 cannot rotate, the processing device 300 may measure backlash of the gear train 270. For example, the processing device 300 may cause the prime mover 203 to rotate the output shaft 272 in a first direction, as indicated by arrow 271, until the output shaft 272 reaches a first rotational (i.e., angular) position at which the output shaft 272 cannot further rotate. Such operation "zeroes" the backlash measurements by ensuring that the teeth of the gears 274, 276, 278 of the gear train 270 are firmly engaged (i.e., in contact) with no gaps or slack therebetween.

The processing device 300 may then cause the prime mover 203 to rotate the output shaft 272 in a second direction, as indicated by arrow 273, until the output shaft 272 reaches a second rotational position at which the output shaft 272 cannot further rotate. It is to be noted that the output shaft 272 cannot rotate further because the gears 274, 276, 278 of the gear train 270 are firmly engaged and the crankshaft 260 is locked in position and cannot rotate, thereby collectively preventing the output shaft 272 from rotating. The processing device 300 may then cause the prime mover 203 to rotate the output shaft 272 in the first direction 271 until the output shaft 272 reaches a third rotational position at which the output shaft 272 cannot further rotate.

While the prime mover 203 rotates the output shaft 272 in the second direction 273 from the first rotational position to the second rotational position and then in the first direction 271 from the second rotational position to the third rotational position, the processing device 300 may receive and record rotational position measurements indicative of the rotational positions of the output shaft 272 facilitated by the rotational position sensor 206. The processing device 300 may then determine the backlash of the gear train in the second direction 273 by determining the rotational distance between the first rotational position of the output shaft 272 and the second rotational position of the output shaft 272 based on the recorded rotational position measurements. The processing device 300 may also determine the backlash of the gear train in the first direction 271 by determining the rotational distance between the second rotational position of the output shaft 272 and the third rotational position of the output shaft 272 based on the recorded rotational position measurements.

The processing device 300 may then determine operational health of the gear train 270 in the first and second directions based on the backlash measurements in the first and second directions. For example, the processing device 300 may be operable to determine that the gear train 270 is worn when the backlash of the gear train 270 is equal to or larger than a predetermined threshold backlash of the gear train 270. The processing device 300 may be operable to measure the backlash of the gear train 270 at predetermined times (e.g., weekly, monthly, after each drilling stage, etc.) and record each backlash determined during each measurement of the backlash. The processing device 300 may be further operable to compare each recorded backlash to a predetermined threshold backlash of the gear train 270, and determine that the gear train 270 is worn when at least one of the recorded backlashes is equal to or larger than the predetermined threshold backlash.

Figure 9:
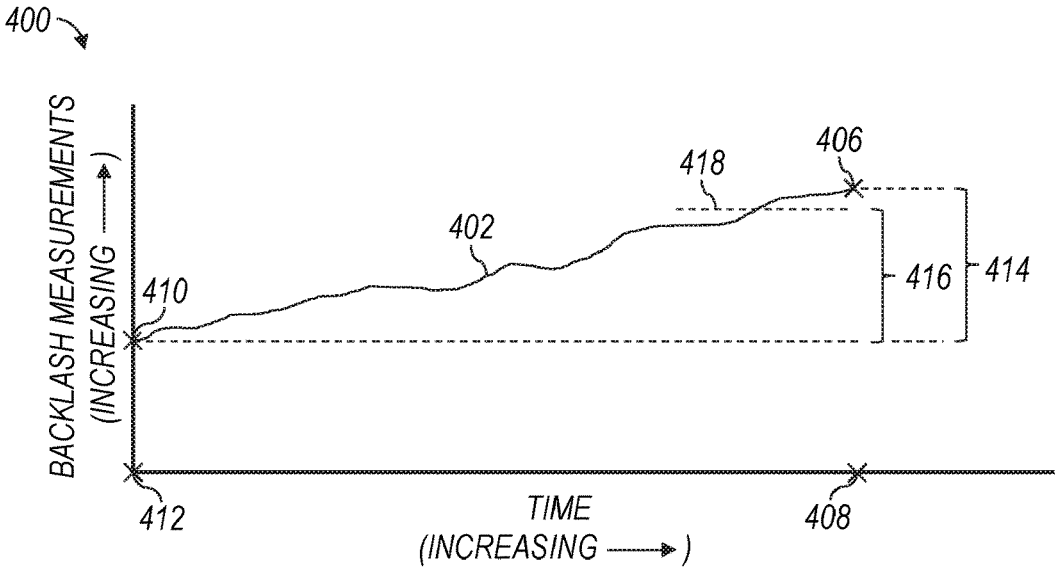
FIG. 9 is a graph related to one or more aspects of the present disclosure.

FIG. 9 is a graph 400 showing example backlash measurements 402 of the gear train 270 in one (i.e., same) direction. The backlash measurements 402 are shown plotted along the vertical axis, with respect to time, which is shown plotted along the horizontal axis. The backlash measurements 402 may be determined and recorded while the operational health monitoring operations of the pump unit 201 are performed. The operational health monitoring operations may be performed periodically (e.g., each day, each few days, each week, after each job, etc.).

The processing device 300 may periodically compare currently (or most recently) received and/or recorded backlash measurements 402 to one or more previously recorded backlash measurements 402. For example, current backlash measurements 406 received and/or recorded by the processing device 300 at a current (or most recent) time 408 may be compared to one or more previously recorded backlash measurements 402, such as baseline backlash measurements 410 (i.e., expected backlash measurements) that were set or recorded by the processing device 300 at time 412. For example, the baseline backlash measurements 410 may have been recorded at time 412 when the gear train 270 was new or just repaired. Therefore, the baseline backlash measurements 410 may comprise backlash measurements associated with a fully or otherwise optimally functional gear train 270. The processing device 300 may then compare the current backlash measurements 406 to the baseline backlash measurements 410 to determine a difference 414 between the current backlash measurements 406 and the baseline backlash measurements 410. The determined difference 414 may be recorded to a database by the processing device 300. The processing device 300 may then determine operational health of the gear train 270 based on the determined difference 414.

For example, if the current backlash measurements 406 and the baseline backlash measurements 410 are substantially similar or match each other, then the gear train 270 may be deemed or otherwise determined as being operationally healthy. However, if the current backlash measurements 406 and the baseline backlash measurements 410 are appreciably different, not substantially similar, or otherwise do not substantially match, then the gear train 270 may be deemed or otherwise determined as being operationally unhealthy (e.g., degraded, worn, leaking, loose, inefficient, etc.). The gear train 270 may also or instead be deemed or otherwise determined as being operationally unhealthy when, for example, the difference 414 (e.g., in profile and/or magnitude) between the current backlash measurements 406 and the baseline backlash measurements 410 is equal to or larger than a difference 416 between the baseline backlash measurements 410 and a predetermined threshold backlash 418. If the gear train 270 was deemed or otherwise determined as being operationally unhealthy, such gear train 270 may then be replaced or repaired.

In view of the entirety of the present disclosure, including the figures and the claims, a person having ordinary skill in the art will readily recognize that the present disclosure introduces an apparatus comprising a system for monitoring operational health of a pump unit operable to pump a fluid, wherein the pump unit comprises a fluid pump, a gear train, and a prime mover operable to actuate the fluid pump via the gear train, wherein the gear train is operatively connected between an output shaft of the prime mover and a crankshaft of the fluid pump, and wherein the system comprises: a rotational position sensor operable to facilitate rotational position measurements indicative of a rotational position of the output shaft; a locking device operable to mechanically engage the crankshaft such that the crankshaft cannot rotate; and a processing device comprising a processor and memory storing computer program code, wherein the processing device is communicatively connected with the prime mover and the rotational position sensor. After the locking device mechanically engages the crankshaft such that the crankshaft cannot rotate, the processing device is operable to measure backlash of the gear train by: causing the prime mover to rotate the output shaft in a first direction until the output shaft reaches a first rotational position at which the output shaft cannot further rotate; causing the prime mover to rotate the output shaft in a second direction until the output shaft reaches a second rotational position at which the output shaft cannot further rotate; recording the rotational position measurements while the prime mover rotates the output shaft in the second direction from the first rotational position to the second rotational position; and determining backlash of the gear train by determining rotational distance between the first rotational position of the output shaft and the second rotational position of the output shaft based on the recorded rotational position measurements.

The processing device may be further operable to determine that the gear train is worn when the backlash of the gear train is equal to or larger than a predetermined threshold backlash of the gear train.

The processing device may be further operable to: measure the backlash of the gear train at predetermined times; record each backlash determined during each measurement of the backlash; compare each recorded backlash to a predetermined threshold backlash of the gear train; and determine that the gear train is worn when at least one of the recorded backlashes is equal to or larger than the predetermined threshold backlash.

The locking device may comprise a latch movable between: a first position in which the latch does not engage the crankshaft, thereby permitting the crankshaft to rotate; and a second position in which the latch engages the crankshaft to mechanically latch the crankshaft to a housing of the fluid pump such that the crankshaft cannot rotate.

The locking device may be communicatively connected with the processing device, and the processing device may be further operable to cause the locking device to move between: a first position in which the locking device does not engage the crankshaft, thereby permitting the crankshaft to rotate; and a second position in which the locking device engages the crankshaft such that the crankshaft cannot rotate.

The locking device may comprise a latch and an actuator operatively connected with the latch and communicatively connected with the processing device, and the processing device may be further operable to cause the actuator to move the latch between: a first position in which the latch does not engage the crankshaft, thereby permitting the crankshaft to rotate; and a second position in which the latch engages the crankshaft such that the crankshaft cannot rotate.

The rotational position sensor may comprise at least one of a rotary encoder, a rotary potentiometer, and a rotary variable-differential transformer.

The gear train may be or comprise at least one of a gear box or transmission of the pump unit operatively connected between the output shaft and the crankshaft.

The present disclosure also introduces a method comprising commencing operation of a processing device to measure backlash of a gear train of a pump unit for pumping a fluid, wherein the pump unit further comprises a fluid pump and a prime mover operable to actuate the fluid pump via the gear train, wherein the gear train is operatively connected between an output shaft of the prime mover and a crankshaft of the fluid pump, and wherein the processing device: receives rotational position measurements indicative of rotational position of the output shaft; causes the prime mover to rotate the output shaft in a first direction until the output shaft reaches a first rotational position at which the output shaft cannot further rotate; causes the prime mover to rotate the output shaft in a second direction until the output shaft reaches a second rotational position at which the output shaft cannot further rotate; records the rotational position measurements while the prime mover rotates the output shaft in the second direction from the first rotational position to the second rotational position; and determines backlash of the gear train by determining rotational distance between the first rotational position of the output shaft and the second rotational position of the output shaft based on the recorded rotational position measurements.

The processing device may also determine that the gear train is worn when the backlash of the gear train is equal to or larger than a predetermined threshold backlash of the gear train.

The method may further comprise, before commencing operation of the processing device to measure the backlash of the gear train, mechanically locking the crankshaft such that the crankshaft cannot rotate.

The processing device may also cause a locking device to engage the crankshaft such that the crankshaft cannot rotate. The locking device may comprise a latch and an actuator operatively connected with the latch and communicatively connected with the processing device, and the processing device may also cause the actuator to move the latch between: a first position in which the latch does not engage the crankshaft, thereby permitting the crankshaft to rotate; and a second position in which the latch engages the crankshaft such that the crankshaft cannot rotate.

The rotational position measurements indicative of rotational position of the output shaft may be facilitated by a rotational position sensor.

The gear train may be or comprise at least one of a gear box or transmission of the pump unit operatively connected between the output shaft and the crankshaft.

The present disclosure also introduces an apparatus comprising a locking device for a reciprocating pump operable to pump a fluid, wherein the locking device is operable to engage a crankshaft of the reciprocating pump such that the crankshaft cannot rotate.

The locking device may be movable between: a first position in which the locking device does not engage the crankshaft, thereby permitting the crankshaft to rotate; and a second position in which the locking device engages the crankshaft such that the crankshaft cannot rotate.

The locking device may comprise a latch movable between: a first position in which the latch does not engage the crankshaft, thereby permitting the crankshaft to rotate; and a second position in which the latch engages the crankshaft to mechanically latch the crankshaft to a housing of the reciprocating pump such that the crankshaft cannot rotate.

The locking device may be remotely operable by an equipment controller to move between: a first position in which the locking device does not engage the crankshaft, thereby permitting the crankshaft to rotate; and a second position in which the locking device engages the crankshaft such that the crankshaft cannot rotate.

The locking device may comprise a latch and an actuator operatively connected with the latch and communicatively connectable with an equipment controller, and the actuator may be operable to receive control signals from the equipment controller to cause the actuator to move the latch between: a first position in which the latch does not engage the crankshaft, thereby permitting the crankshaft to rotate; and a second position in which the latch engages the crankshaft to mechanically latch the crankshaft to a housing of the reciprocating pump such that the crankshaft cannot rotate.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a system for monitoring operational health of a pump unit operable to pump a fluid, wherein the pump unit comprises a fluid pump, a gear train, and a prime mover operable to actuate the fluid pump via the gear train, wherein the gear train is operatively connected between an output shaft of the prime mover and a crankshaft of the fluid pump, and wherein the system comprises:

a rotational position sensor operable to facilitate rotational position measurements indicative of a rotational position of the output shaft;

a locking device operable to mechanically engage the crankshaft such that the crankshaft cannot rotate; and a processing device comprising a processor and memory storing computer program code, wherein the processing device is communicatively connected with the prime mover and the rotational position sensor, and wherein, after the locking device mechanically engages the crankshaft such that the crankshaft cannot rotate, the processing device is operable to measure backlash of the gear train by:

causing the prime mover to rotate the output shaft in a first direction until the output shaft reaches a first rotational position at which the output shaft cannot further rotate;

causing the prime mover to rotate the output shaft in a second direction until the output shaft reaches a second rotational position at which the output shaft cannot further rotate;

recording the rotational position measurements while the prime mover rotates the output shaft in the second direction from the first rotational position to the second rotational position; and determining backlash of the gear train by determining rotational distance between the first rotational position of the output shaft and the second rotational position of the output shaft based on the recorded rotational position measurements.

2. The apparatus of claim 1 wherein the processing device is further operable to determine that the gear train is worn when the backlash of the gear train is equal to or larger than a predetermined threshold backlash of the gear train.

3. The apparatus of claim 1 wherein the processing device is further operable to:

measure the backlash of the gear train at predetermined times;

record each backlash determined during each measurement of the backlash;

compare each recorded backlash to a predetermined threshold backlash of the gear train; and determine that the gear train is worn when at least one of the recorded backlashes is equal to or larger than the predetermined threshold backlash.

4. The apparatus of claim 1 wherein the locking device comprises a latch movable between:

a first position in which the latch does not engage the crankshaft, thereby permitting the crankshaft to rotate; and a second position in which the latch engages the crankshaft to mechanically latch the crankshaft to a housing of the fluid pump such that the crankshaft cannot rotate.

5. The apparatus of claim 1 wherein:

the locking device is communicatively connected with the processing device; and the processing device is further operable to cause the locking device to move between:

a first position in which the locking device does not engage the crankshaft, thereby permitting the crankshaft to rotate; and a second position in which the locking device engages the crankshaft such that the crankshaft cannot rotate.

6. The apparatus of claim 1 wherein:

the locking device comprises:

a latch; and an actuator operatively connected with the latch and communicatively connected with the processing device; and the processing device is further operable to cause the actuator to move the latch between:

a first position in which the latch does not engage the crankshaft, thereby permitting the crankshaft to rotate; and a second position in which the latch engages the crankshaft such that the crankshaft cannot rotate.

7. The apparatus of claim 1 wherein the rotational position sensor comprises at least one of a rotary encoder, a rotary potentiometer, and a rotary variable-differential transformer.

8. The apparatus of claim 1 wherein the gear train is or comprises at least one of a gear box or transmission of the pump unit operatively connected between the output shaft and the crankshaft.

9. A method comprising:

commencing operation of a processing device to measure backlash of a gear train of a pump unit for pumping a fluid, wherein the pump unit further comprises a fluid pump and a prime mover operable to actuate the fluid pump via the gear train, wherein the gear train is operatively connected between an output shaft of the prime mover and a crankshaft of the fluid pump, and wherein the processing device:

receives rotational position measurements indicative of rotational position of the output shaft;

causes the prime mover to rotate the output shaft in a first direction until the output shaft reaches a first rotational position at which the output shaft cannot further rotate;

causes the prime mover to rotate the output shaft in a second direction until the output shaft reaches a second rotational position at which the output shaft cannot further rotate;

records the rotational position measurements while the prime mover rotates the output shaft in the second direction from the first rotational position to the second rotational position; and determines backlash of the gear train by determining rotational distance between the first rotational position of the output shaft and the second rotational position of the output shaft based on the recorded rotational position measurements.

10. The method of claim 9 wherein the processing device also determines that the gear train is worn when the backlash of the gear train is equal to or larger than a predetermined threshold backlash of the gear train.

11. The method of claim 9 further comprising, before commencing operation of the processing device to measure the backlash of the gear train, mechanically locking the crankshaft such that the crankshaft cannot rotate.

12. The method of claim 9 wherein the processing device also causes a locking device to engage the crankshaft such that the crankshaft cannot rotate.

13. The method of claim 12 wherein:

the locking device comprises:

a latch; and an actuator operatively connected with the latch and communicatively connected with the processing device; and the processing device also causes the actuator to move the latch between:

a first position in which the latch does not engage the crankshaft, thereby permitting the crankshaft to rotate; and a second position in which the latch engages the crankshaft such that the crankshaft cannot rotate.

14. The method of claim 9 wherein the rotational position measurements indicative of rotational position of the output shaft are facilitated by a rotational position sensor.

15. The method of claim 9 wherein the gear train is or comprises at least one of a gear box or transmission of the pump unit operatively connected between the output shaft and the crankshaft.

16. An apparatus comprising:

a locking device for a reciprocating pump operable to pump a fluid, wherein the locking device is operable to engage a crankshaft of the reciprocating pump such that the crankshaft cannot rotate.

17. The apparatus of claim 16 wherein the locking device is movable between:

a first position in which the locking device does not engage the crankshaft, thereby permitting the crankshaft to rotate; and a second position in which the locking device engages the crankshaft such that the crankshaft cannot rotate.

18. The apparatus of claim 16 wherein the locking device comprises a latch movable between:

a first position in which the latch does not engage the crankshaft, thereby permitting the crankshaft to rotate; and a second position in which the latch engages the crankshaft to mechanically latch the crankshaft to a housing of the reciprocating pump such that the crankshaft cannot rotate.

19. The apparatus of claim 16 wherein the locking device is remotely operable by an equipment controller to move between:

a first position in which the locking device does not engage the crankshaft, thereby permitting the crankshaft to rotate; and a second position in which the locking device engages the crankshaft such that the crankshaft cannot rotate.

20. The apparatus of claim 16 wherein:

the locking device comprises:

a latch; and an actuator operatively connected with the latch and communicatively connectable with an equipment controller; and the actuator is operable to receive control signals from the equipment controller to cause the actuator to move the latch between:

a first position in which the latch does not engage the crankshaft, thereby permitting the crankshaft to rotate; and a second position in which the latch engages the crankshaft to mechanically latch the crankshaft to a housing of the reciprocating pump such that the crankshaft cannot rotate.

* * * * *